US006018855A

United States Patent [19]

Drigani et al.

[11] Patent Number: 6,018,855

[45] Date of Patent: Feb. 1, 2000

[54] MOVABLE INSULATED CONVEYOR FOR THE CONTINUOUS CASTING OF SLABS

[75] Inventors: Fausto Drigani, Zugliano; Pietro Morasca, Fresonara, both of Italy

[73] Assignee: Danieli & C. Officine Meccaniche SPA, Buttrio, Italy

[21] Appl. No.: 08/323,923

[22] Filed: Oct. 17, 1994

[30] Foreign Application Priority Data

Oct. 19, 1993 [IT] Italy ..... UD93A0210

[51] Int. Cl.[7] ..... B21B 1/46; B21B 13/22; B22D 11/12

[52] U.S. Cl. ..... 29/33 C; 29/527.7; 164/417

[58] Field of Search ..... 164/417, 476, 164/477; 29/33 C, 527.7

[56] References Cited

U.S. PATENT DOCUMENTS

| | | | |
|---|---|---|---|
| 3,385,579 | 5/1968 | Peck et al. . | |
| 4,420,029 | 12/1983 | Kameyama et al. | 164/417 |
| 5,305,515 | 4/1994 | Fastert et al. | 29/33 C X |

FOREIGN PATENT DOCUMENTS

| | | | |
|---|---|---|---|
| 0492226 | 7/1992 | European Pat. Off. . | |
| 534578 | 9/1931 | Germany . | |
| 1130459 | 5/1962 | Germany . | |
| 3901582 | 8/1990 | Germany . | |
| 55-45530 | 3/1980 | Japan . | |
| 58-168416 | 10/1983 | Japan | 29/33 C |

*Primary Examiner*—J. Reed Batten, Jr.
*Attorney, Agent, or Firm*—Antonelli, Terry, Stout & Kraus, LLP

[57] ABSTRACT

Movable insulated conveyor for the continuous casting of slabs, billets, blooms or other products, which is installed in line with a continuous casting plant (13) comprising at least two casting lines (11*a*–11*b*), at least one shears (14) and a first stationary tunnel furnace (15) to accommodate and accelerate segments of slabs (31) being positioned between the continuous casting plant (13) and a rolling train (12), a movable tunnel furnace (16) possibly being included in succession to the stationary tunnel furnace (15), at least one of the movable insulated conveyors (19) being comprised in succession to the stationary tunnel furnace (15) and/or upstream of, and in direct cooperation with, the rolling train (12), the movable insulated conveyor (19) including a lower base (32) to support rollers (33) conveying the segments of slabs (31) and an upper insulated and heated hood (20), which at least in the working position is immovable laterally and lengthwise, the lower supporting base (32) being capable of being oriented at least laterally about a substantially vertical axis of rotation (17).

27 Claims, 2 Drawing Sheets

MOVABLE INSULATED CONVEYOR FOR THE CONTINUOUS CASTING OF SLABS

BACKGROUND OF THE INVENTION

This invention concerns a movable insulated conveyor for the continuous casting of slabs.

The slabs with which the invention is concerned are advantageously from 700 to 2500 millimeters wide and from 30 to 200 millimeters thick.

However, the invention is also applied to billets, blooms or slabs of other dimensions.

The invention is applied advantageously to plants which connect at least two continuous casting lines to a rolling train.

The state of the art covers plants for the continuous casting of thin slabs, the plants including a plurality of casting lines tending one or more rolling lines at the same time.

EP-A-0492226 discloses, for instance, two or three continuous casting lines, each of which is served by tunnel furnaces.

A disclosure which is analogous from many standpoints is contained in JP-A-55-45530.

These two prior art documents teach that the rolling line is brought into connection alternatively with the casting lines by means of rotation of terminal segments of tunnel furnaces about the end of the segment in question. This rotation takes place at one end of the segments and entails problems of travel, inertia, installed power and loss of heat; problems concerning the transfer and control of the heat delivered by possible burners are also involved.

It should be borne in mind that these tunnel furnaces are very heavy and their movement is often difficult.

DE-A-3.901.582 discloses a lay-out in which a roller conveyor fitted to a rotary platform is included between the casting lines and the rolling train. The axis of rotation of the platform is located at a position at the centre of the length of the roller conveyor or at one of the ends of the conveyor, but this lay-out too does not overcome the above problems of travel, installed power, difficulty of movement and loss of heat.

Moreover, these lay-outs make it necessary that the lines to feed the burners and the means to recover fumes should be movable so as to be able to conform to the movements of the tunnel furnaces or roller conveyors.

Furthermore, these lay-outs do not permit work to be carried out, from above with an open top and without sidewalls, for maintenance or replacement of the rollers positioned on the floor of the tunnel furnaces, although such work is quite frequent in view of the thermal and mechanical stresses discharged onto the rollers.

In the state of the art such work requires either the lateral removal of the rollers or the removal of the roof of the tunnel furnace but does not eliminate the problems connected to the presence of the sidewalls.

Moreover, these lay-outs do not provide for the possible inclusion of large storage spaces required for periodical work needed in the rolling line and/or for any stoppages due to accidents.

Besides, in the case of special products or particular events the lay-outs of the state of the art do not provide for the ability to make use of stored slabs or blooms as an alternative to or in replacement of these arriving from the casting line, the store being hot or cold.

Moreover, the state of the art does not provide for the arrangement of momentary positions for storing the slabs outside the casting line, such storage positions being quickly accessible for performing operations of inspection, hot conditioning, cropping, shearing-to-size, etc.

Furthermore the state of the art does not allow for associating with the casting line a store for a cold charge or for special products, this store being able to be quickly and readily positioned in communication with the casting line.

SUMMARY OF THE INVENTION

The present applicants have therefore investigated the problem and have achieved, to their surprise, a simple and very functional lay-out.

A casting line for slabs, billets and blooms comprises in a known manner not only the continuous casting machine but also at least descaling means, shears and at least one first stationary tunnel furnace to accommodate, accelerate and space apart the segments of slab, the whole being followed by at least one rolling train.

Hereinafter, for the sake of simplicity we shall mention only slabs and, in particular, thin slabs.

The stationary tunnel furnace includes an inner roller conveyor and also has the task of heating, and/or equalizing the temperature of, the segments of slab.

At least one movable conveyor of an insulated type is included according to the invention downstream of the first stationary tunnel furnace. This movable insulated conveyor is suitable to rotate about a substantially vertical axis of rotation in cooperation with movable tunnel furnaces or other movable conveyors so as to connect one or the other casting line alternatively to the rolling train.

According to the invention the movable insulated conveyor includes a lower supporting base which can be moved laterally, whereas its upper insulation hood, which is advantageously heated by burners, is immovable.

This lay-out makes it possible to carry out a very quick and easy handling of the movable insulated conveyor notwithstanding the considerable weight of the structure comprising the insulation hood, which is normally associated with the fumes-discharge stack, with the burners and with other heavy, bulky, functional and infrastructural components.

It is also especially advantageous to keep always in a determined stationary position the means supplying the burners and the fumes discharge means associated with the stack to aspirate the fumes.

Moreover, it is advantageous to carry out from above the operations of maintenance or replacement of the rollers by merely rotating or displacing sideways the lower supporting base in relation to the stationary insulation hood.

According to a variant the insulation hood can be raised and lowered in relation to the lower supporting base so as to facilitate, and prevent contact by, the angular rotation of the lower supporting base.

According to another variant the insulation includes, towards the inside of the tunnel furnace, a lining of an athermanous material with a high reflectance power.

According to the invention the upper insulation hood is associated with means to monitor and control the temperature, the position of the movable conveyors and possibly the position of the slab. These monitoring means, like the other control and actuation means, are associated with a data processing and control unit.

The movable insulated conveyor can be associated either with the first stationary tunnel furnace by means of a movable tunnel furnace or by means of another analogous movable insulated conveyor, or with one or more storage tunnel furnaces positioned beside the processing line.

The storage tunnel furnaces can be used either for storing the slabs or for inspecting them or for checking operations.

Moreover, the storage tunnel furnaces according to a variant may include heating conditioning means to ready the slabs before the rolling.

According to another variant the storage tunnel furnaces are associated with shears for cropping and shearing to size the slabs, thus enabling a semi-finished product sheared to size to be discharged.

According to the invention the line may include two or more movable insulated conveyors for each casting line, each conveyor being capable of being associated with one or more storage tunnel furnaces.

According to a variant an induction furnace cooperating with a second stationary tunnel furnace performing temperature equalisation and making uniform the temperature of the slabs is included downstream of the movable insulated conveyors.

According to the invention, as we said before, the movable insulated conveyors can be oriented laterally at one of their ends or about a vertical axis positioned advantageously at the centre of the length of the conveyor; in this latter case the discharge stack will be positioned on the same axis as the axis of rotation of the conveyor.

This last lay-out not only balances the forces and requires less power but also makes possible the centralisation of the controls and the sources of heat such as the fuels and, above all, the centralisation of the fumes discharge stack.

The centralisation of the fumes discharge stack is important because it makes unnecessary any special work to be carried out on the ceiling of the hood.

According to the invention the movable insulated conveyors and the tunnel furnaces include at their ends doors which open and close, advantageously automatically, depending on whether the conveyors are or are not cooperating with the tunnel furnaces, the purpose being to reduce to a minimum the dispersion of heat.

According to the invention the floor of the movable conveyors consists of cooled rollers when the slabs have a thickness from 30 to about 70 millimeters, and in some cases when the slabs are up to even 100 millimeters thick. When the slabs are more than 100 millimeters thick, the floor of the tunnel furnaces and conveyors is conformed with walking beams.

The floor of the tunnel furnaces may also be conformed with walking beams for thicknesses of slab of 70–75 millimeters or more.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENT

Figures 1, 2, 3:
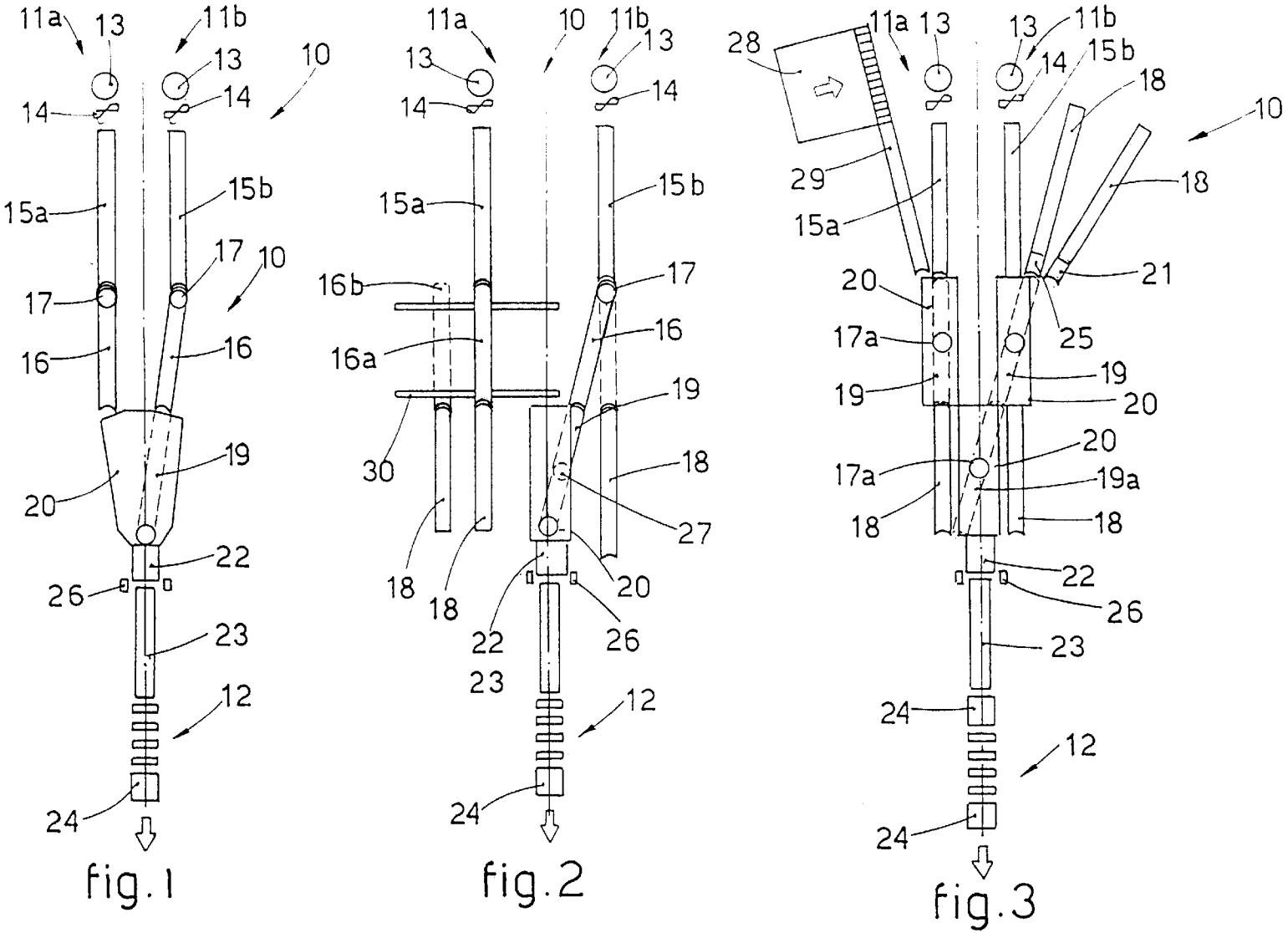
FIG. 1 shows a possible Lay-out of a rolling line which employs a movable conveyor according to the invention.
FIGS. 2 and 3 show possible variants of the embodiment of the rolling line of FIG. 1.

A rolling line 10 shown in FIGS. 1 to 3 includes in this example two continuous casting lines 11*a* and 11*b* respectively connected at their downstream end to a rolling train 12.

In this case the rolling train 12 is located at an intermediate position between the casting lines 11 and serves both those casting lines 11.

According to a variant the rolling train 12 lies on the same axis as one of the two casting lines 11 and can serve the other casting line too alternatively.

According to another variant three or more casting lines 11 are included and are associated with two or more rolling trains 12.

The rolling train 12 is of a known type and may be of a reversible, non-reversible or combined type.

Each continuous casting line 11*a*–11*b* comprises at least one continuous casting plant 13, a shears 14 for shearing to size, one or more descaling units and a first stationary tunnel furnace 15, namely 15*a* and 15*b* respectively, to accommodate and accelerate segments of slab 31 leaving the step of being sheared to size.

The continuous casting plant 13 is of a known type and employs the common and normal service machines.

In the example of FIGS. 1 and 2 a movable tunnel furnace 16 is included in each casting line 11 downstream of the first stationary tunnel furnace 15 and is followed by a movable insulated conveyor 19.

In the lay-out shown the movable tunnel furnace 16 can rotate by an angle about a vertical axis 17 located substantially at one end of the movable tunnel furnace 16. This enables the one or the other movable tunnel furnace 16 working at that moment to align itself with the movable insulated conveyor 19, which too has taken up a transfer position at an angle coordinated with the position of the movable tunnel furnace 16 so as to feed the downstream rolling train 12.

In the variant shown in FIG. 2 at least one movable tunnel furnace, the tunnel furnace 16*a* in this case, can be moved sideways, for instance on rails 30, from a first position in which it is on the same axis as the respective casting line 11 to a second position 16*b*, shown with lines of dashes in the figure, for transfer of slabs for instance to or from a storage tunnel furnace 18, and then can be moved to a third position (not shown) for transfer of slabs to the movable insulated conveyor 19, this third position being located in this case on the axis of the rolling train 12.

According to another variant shown in FIG. 3 each casting line 11*a*–11*b* includes a movable insulated conveyor 19 associated directly with the relative stationary tunnel furnace 15*a*–15*b*; these movable insulated conveyors 19 are associated in turn with a further downstream movable insulated conveyor 19*a*, which is positioned on the same axis as, and feeds, the rolling train 12.

According to a variant at least one of the movable insulated conveyors 19 cooperates with rails 30 so as to be able to traverse laterally in order to be brought into alignment with a storage tunnel furnace 18 or with the downstream movable insulated conveyor 19*a*.

In the example of FIG. 3 the movable insulated conveyors 19–19*a* are rotated about their own vertical and longitudinally central axis 17*a*.

The movable insulated conveyors 19 have the task of connecting either of the two casting lines 11*a*–11*b* alternatively to the rolling train 12 (FIGS. 1, 2 and 3). They have the task also of transferring the segments of slab 31 to momentary parked positions.

The movable insulated conveyors 19 according to the invention (FIG. 4) comprise a lower supporting base 32, on which the conveyor rollers 33 are supported at their ends.

The segment of slab 31 is conveyed on the rollers 33.

In this case the lower supporting base 32 is associated with wheels 34, which run on suitably conformed rails 35, conformed as an arc of a circle for instance, for the lateral rotary movement to be imparted to the movable insulated conveyor 19.

The actuation of the movement of the lower supporting base 32 is provided by a jack 36 in this case. Actuation of the jack 36 is governed by a signal announcing that the whole segment of the thin slab 3 is positioned within the movable insulated conveyor 19 and that any inlet doors present have been closed.

In this example the rollers 33 are cooled by a continuous flow of cooling fluid under pressure and include cooling fluid delivery means 37 and cooling fluid outlet means 38 to create a cooling circuit.

The lower supporting base 32 cooperates at its upper end with an insulated hood 20 in creating an inner heating and temperature-maintaining chamber 41.

The sidewalls of the insulated hood 20 are equipped in this case with a plurality of heating means consisting of burners 40.

Figure 4:
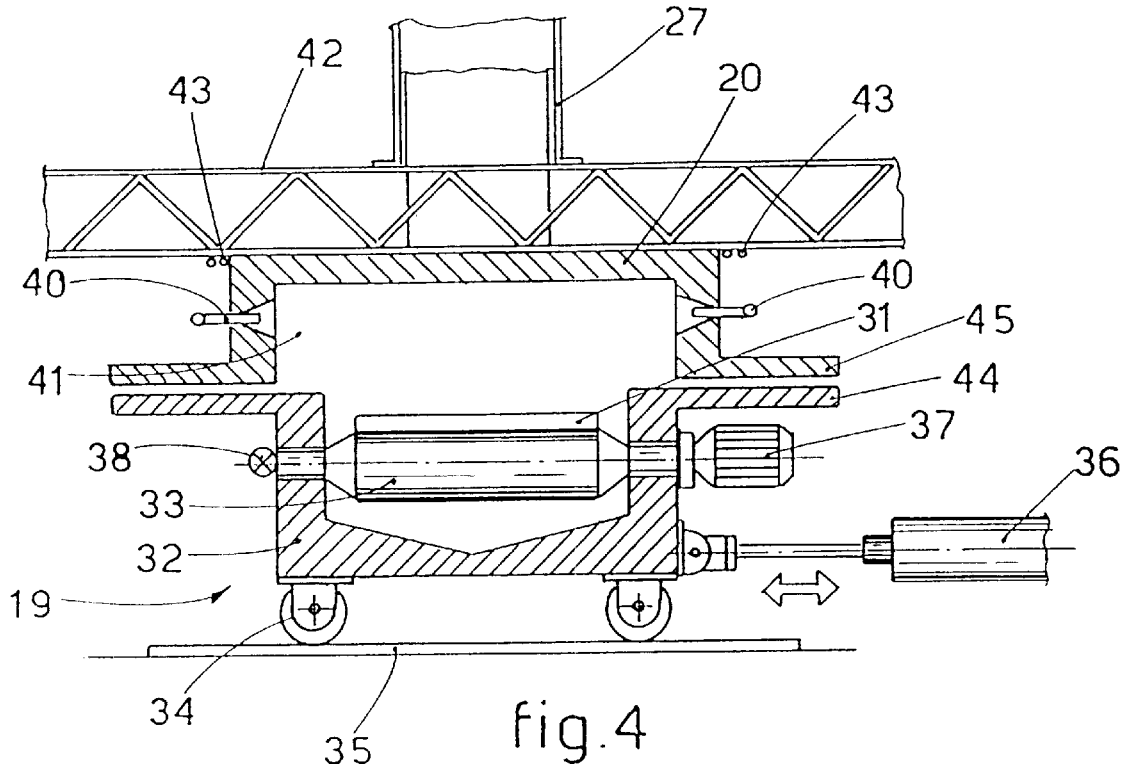
FIG. 4 shows a cross-section of a possible embodiment of the movable insulated conveyor according to the invention.

In the embodiment shown in FIG. 4 the insulated hood 20 is immovably fitted to a carrying structure 42 and always stays in that position even during movement of the lower supporting base 32. The carrying structure 42 is of a known type and can be of any type. At least conduits 43 to feed the burners 40 are secured to the carrying structure 42.

When necessary for the processing requirements, this lay-out enables a much lighter structure to be moved, with the resulting advantages of speed of performance, accuracy of alignment, less power employed, etc.

Moreover, the conduits 43 to feed the burners 40 and a fumes aspiration stack 27 do not have to follow the movement of the lower supporting base 32, thus making the whole structure much more versatile and easy to handle. Moreover this lay-out enables corrective work to be carried out from above with an open top for maintenance and/or replacement work on the conveyor rollers 33.

The lower supporting base 32 and the insulated hood 20 comprise mating jutting edges 44 and 45 protruding outwards from the heating and temperature-maintaining chamber 41 for the purpose of keeping the segment of the slab 31 covered at least partly by the insulated hood 20 within a certain range of lateral displacement of the lower supporting base 32.

The jutting edges 44–45 have the purpose also of forming a protected seating for the roller cooling means 37–38 or for the burner feeder conduits 40 and also serve to maintain the temperature in the heating and temperature-maintaining chamber 41.

The insulated hood 20 can also possess the substantially trapezoidal conformation shown in FIG. 1 so as to achieve a still better protective condition.

Figure 5:
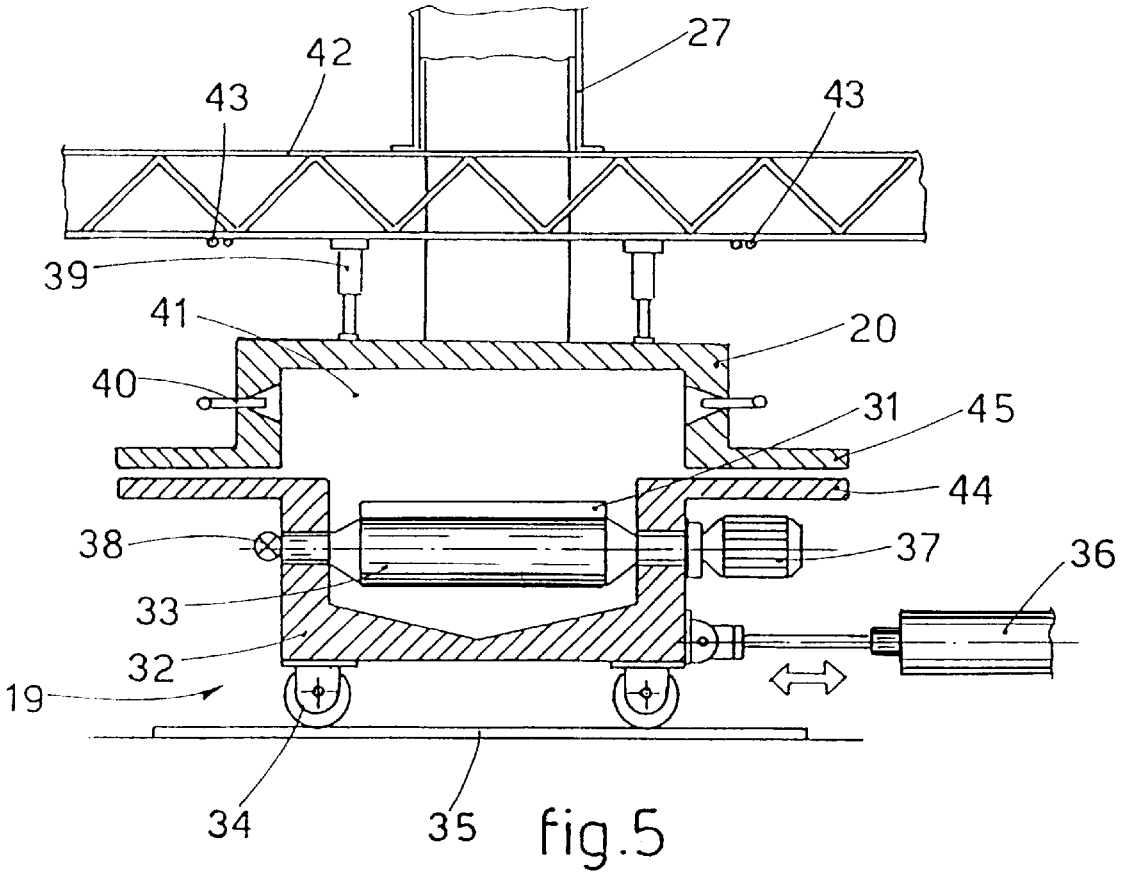
FIG. 5 shows a variant of FIG. 4.

According to a variant shown in FIG. 5 the insulated hood 20 is associated with the carrying structure 42 through jacks 39, which enable the hood 20 to be raised and lowered in relation to the lower supporting base 32.

The insulated hood 20 may be lifted when the lower supporting base 32 has to be moved into alignment with one or the other of the stationary 15 or movable 16 tunnel furnaces positioned upstream or with other downstream processing units of the rolling line 10. This lessens the possibility of impacts between the insulated hood 20 and the lower supporting base 32 during movements of the latter, while retaining at the same time an excellent closure.

The insulated hood 20 is then lowered onto the lower supporting base 32 when the latter 32 takes up again a stationary position for the passage of the segment of slab 31.

The movable insulated conveyors 19 and also the movable tunnel furnaces 16 can be associated momentarily with tunnel furnaces 18 having a storage function; these storage tunnel furnaces 18 are positioned at the sides of the casting lines 11.

The storage tunnel furnaces 18, if they are associated with rotary movable insulated conveyors 19, are arranged in the manner of spokes circumferentially about the axis of rotation 17 of the movable insulated conveyors 19.

The storage tunnel furnaces 18 have several purposes. A first purpose may be to act as a temporary parking means for segments of slab 31 in the event of problems downstream, for instance when the rolls of the rolling train 12 have to be replaced without stopping the working of the casting machines 13.

According to a variant the storage tunnel furnaces 18 are employed for the performance of special processes or inspections on the segments of slab 31 before the segments 31 are sent to the rolling train 12. In this connection at least one storage tunnel furnace 18 can be associated with a checking and inspection station.

According to a variant at least one storage tunnel furnace 18 is associated with a conditioning unit 25 able to remove material in the hot state from the surface of the segment of slab 31 within the storage tunnel furnace 18 so as to eliminate any surface defects and to ready the segment 31 for rolling.

According to another variant at least one storage tunnel furnace 18 is associated with a unit 21 that shears to size and/or crops the leading and trailing ends of the slab.

According to yet another variant at least one storage tunnel furnace 18 is associated with a temperature-maintaining furnace, which can store at least two slabs positioned side by side or in line and having a thickness between 75 and 200 millimeters.

In special cases, such as, for instance, when at least one storage tunnel furnace 18 is associated with a store 28 for cold products used to feed the rolling line 10 with cold products to be sent for rolling, the storage tunnel furnace 18 can be used also as a pre-heating furnace 29.

In the rolling line 10 according to the invention each movable insulated conveyor 19 can cooperate with two or more storage tunnel furnaces 18.

The movable insulated conveyors 19, movable tunnel furnaces 16 and storage tunnel furnaces 18 are equipped with doors which can be opened for the passage of segments of slab 31 and which close when the whole segment 31 is inside so as to prevent dispersion of heat.

The movable tunnel furnaces 16 and storage tunnel furnaces 18 can also include insulator means and/or be equipped with heating and temperature-maintaining means.

Moreover, the floor of the movable tunnel furnaces 16 and of the storage tunnel furnaces 18 is conformed with rollers, which are advantageously but not necessarily cooled, to hold small dimensions of segments of slab, for instance with thicknesses between 30 and about 70 millimeters but in some cases even up to 100 millimeters.

Where the slabs have a greater thickness, the floor of the movable insulated conveyors 19, movable tunnel furnaces 16 and storage tunnel furnaces 18 may be conformed with walking beams.

The rolling line 10 downstream of the last movable insulated conveyor 19 may include an induction furnace 22, which ensures a speedy increase of the temperature of the slab 31; this induction furnace 22 is installed upstream of a temperature-equalisation furnace 23, which has the task of stabilising and making uniform in depth the temperature of the segments 31 passing through.

At least one descaling unit 26 may possibly be included between the induction furnace 22 and the temperature-equalisation furnace 23. The rolling train 12 is located at the outlet of the temperature-equalisation furnace 23 and may cooperate downstream, and possibly also upstream, if it is of a reversible type, with coiling units 24.

We claim:

1. Movable insulated conveyor for the continuous casting of slabs, billets, blooms or other products, which is installed in line with a continuous casting plant comprising at least two casting lines, at least one shears and a first stationary tunnel furnace to accommodate and accelerate segments of slabs being positioned between the continuous casting plant and a rolling train the movable insulated conveyor being provided downstream of the stationary tunnel furnace to support rollers conveying the segments of slabs and an upper insulated and heated hood, which at least in a working position is immovable laterally and lengthwise, the lower supporting base being capable of being oriented at least laterally with respect to the upper insulated and heated hood about a substantially vertical axis of rotation.

2. Movable insulated conveyor as in claim 1, whereby the upper insulated and heated hood is vertically stationary.

3. Movable insulated conveyor as in claim 1, whereby the upper insulated and heated hood is movable vertically from a lowered position for closure of the lower supporting base to a raised position of no contact with the lower supporting base.

4. Movable insulated conveyor as in claim 1, whereby the upper insulated and heated hood is associated with heating burner means.

5. Movable insulated conveyor as in claim 1, whereby the upper insulated and heated hood is associated with a fumes aspiration stack.

6. Movable insulated conveyor as in claim 5, whereby the vertical axis of rotation of the lower supporting base is located substantially at the centre of the length of that base, the stack being coaxial with that axis.

7. Movable insulated conveyor as in claim 1 inclusive, whereby the vertical axis of rotation of the lower supporting base is positioned in the vicinity of its end closest to the stationary tunnel furnace or to the rolling train.

8. Movable insulated conveyor as in claim 1, which has at least a first position on the same axis as the stationary tunnel furnace or as the rolling train, and at least a second position at an angle to the first position and lying on the same axis as the movable tunnel furnace lying in a position at an angle of the latter, or as another movable insulated conveyor in its second position at an angle, or as a storage tunnel furnace.

9. Movable insulated conveyor as in any claim hereinbefore, which cooperates with at least one storage tunnel furnace associated with a unit for shearing to size and/or cropping the slabs.

10. Movable insulated conveyor as in claim 1, which cooperates with at least one storage tunnel furnace associated with a hot-conditioning unit.

11. Movable insulated conveyor as in claim 1, which cooperates with at least one storage tunnel furnace associated with an inspection station.

12. Movable insulated conveyor as in claim 1, which cooperates with at least one storage tunnel furnace associated with a store of cold products.

13. Movable insulated conveyor as in claim 1, which cooperates with at least one storage tunnel furnace having the task of a pre-heating furnace.

14. Movable insulated conveyor as in claim 1, which cooperates downstream with an induction furnace followed by a temperature-equalisation furnace.

15. Movable insulated conveyor as in claim 1, which cooperates downstream with at least one descaling unit.

16. Movable insulated conveyor as in claim 1, which comprises at its ends doors having an opened position and a closed position, the opened and closed positions being correlated with the respective opened and closed positions of the stationary tunnel furnaces, movable tunnel furnaces and storage tunnel furnaces associated with the movable insulated conveyor from time to time.

17. Movable insulated conveyor as in claim 1, which has at least part of its floor conformed with cooled rollers.

18. Movable insulated conveyor as in claim 1, wherein lateral walls of the upper insulated and heated hood include horizontally extending jutting edges.

19. Movable insulated conveyor as in claim 18, wherein lateral walls of the lower supporting base include horizontally extending jutting edges mating with at least portions of the horizontally extending jutting edges of the lateral walls of the upper insulated and heated hood.

20. A continuous casting plant comprising:

at least two casting lines;

at least one shears for shearing cast product;

a rolling train;

a first stationary tunnel furnace to accommodate and accelerate segments of slabs, the first stationary tunnel furnace being positioned between the at least two casting lines and the rolling train; and at least one movable insulated conveyor, the at least one movable insulated conveyor being provided between the stationary tunnel furnace and the rolling train, the at least one movable insulated conveyor including a lower supporting base to support rollers conveying segments of slabs and an upper insulated and heated hood, which at least in a working position is immovable laterally and lengthwise, the lower supporting base being capable of being oriented at least laterally with respect to the upper insulated and heated hood about a substantially vertical axis of rotation.

21. A continuous casting plant according to claim 20, wherein the upper insulated and heated hood is immovable.

22. A continuous casting plant according to claim 20, wherein the upper insulated and heated hood is movable only in a vertical direction.

23. A continuous casting plant according to claim 20, further comprising a fumes aspiration stack operably connected to the upper insulated and heated hood.

24. A continuous casting plant according to claim 20, wherein the substantially vertical axis of rotation of the lower supporting base is provided substantially at a center of a length of the lower supporting base.

25. A continuous casting plant according to claim 24, further comprising a fumes aspiration stack operably connected to the upper insulated and heated hood at a position substantially coaxial with the substantially vertical axis of rotation of the lower supporting base.

26. A continuous casting plant according to claim 20, wherein lateral walls of the upper insulated and heated hood include horizontally extending jutting edges.

27. A continuous casting plant according to claim 26, wherein lateral walls of the lower supporting base include horizontally extending jutting edges mating with at least portions of the horizontally extending jutting edges of the lateral walls of the upper insulated and heated hood.

* * * * *